US009453273B2

(12) United States Patent
Matsumoto et al.

(10) Patent No.: US 9,453,273 B2
(45) Date of Patent: Sep. 27, 2016

(54) ALUMINUM ALLOY SHEET WITH EXCELLENT PAINT-BAKE HARDENABILITY

(71) Applicant: Kobe Steel, Ltd., Kobe-shi (JP)

(72) Inventors: Katsushi Matsumoto, Kobe (JP); Yasuhiro Aruga, Kobe (JP); Hisao Shishido, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 87 days.

(21) Appl. No.: 14/373,387

(22) PCT Filed: Jan. 29, 2013

(86) PCT No.: PCT/JP2013/051896
§ 371 (c)(1),
(2) Date: Jul. 21, 2014

(87) PCT Pub. No.: WO2013/121876
PCT Pub. Date: Aug. 22, 2013

(65) Prior Publication Data

US 2015/0007909 A1 Jan. 8, 2015

(30) Foreign Application Priority Data

Feb. 16, 2012 (JP) ..... 2012-031811

(51) Int. Cl.

| | |
|---|---|
| ***C22C 21/02*** | (2006.01) |
| ***C22F 1/05*** | (2006.01) |
| ***C22F 1/00*** | (2006.01) |
| ***C22C 21/08*** | (2006.01) |

(52) U.S. Cl.
CPC ..... *C22F 1/05* (2013.01); *C22C 21/02* (2013.01); *C22C 21/08* (2013.01); *C22F 1/00* (2013.01)

(58) Field of Classification Search
CPC ..... C22C 21/02; C22F 1/05
See application file for complete search history.

(56) References Cited

U.S. PATENT DOCUMENTS

2009/0081072 A1* 3/2009 Zhao et al. ..... 420/535

FOREIGN PATENT DOCUMENTS

| | | |
|---|---|---|
| JP | 5-230605 | 9/1993 |
| JP | 8-253832 A | 10/1996 |
| JP | 10-219382 | 8/1998 |
| JP | 2000-273567 | 10/2000 |
| JP | 2001-329328 | 11/2001 |

(Continued)

OTHER PUBLICATIONS

A. Serizawa, et al., "Three-Dimensional Atom Probe Characterization of Nanoclusters Responsible for Multistep Aging Behavior of an Al—Mg—Si Alloy" Metallurgical and Materials Transactions A, vol. 39A, Feb. 2008, pp. 243-251.

*Primary Examiner* — Roy King
*Assistant Examiner* — Janelle Morillo
(74) *Attorney, Agent, or Firm* — Oblon, McClelland, Maier & Neustadt, L.L.P

(57) ABSTRACT

This aluminum alloy sheet is a 6000-series aluminum alloy sheet of a specific composition which, after rolling, has undergone solution hardening and reheating as tempering treatments. The aluminum alloy sheet in differential scanning calorimetry gives a curve in which the exothermic-peak heights A, B, and C in respective specific temperature ranges have relationships within specific given ranges to thereby raise the increase in 0.2% proof stress through low-temperature short-time artificial age-hardening to 100 MPa or more.

6 Claims, 1 Drawing Sheet

(56) References Cited

FOREIGN PATENT DOCUMENTS

| | | | |
|---|---|---|---|
| JP | 2003-27170 | | 1/2003 |
| JP | 2005-139537 | | 6/2005 |
| JP | 2005139537 A | * | 6/2005 |
| JP | 2006-9140 | | 1/2006 |
| JP | 4117243 B2 | | 4/2008 |

* cited by examiner

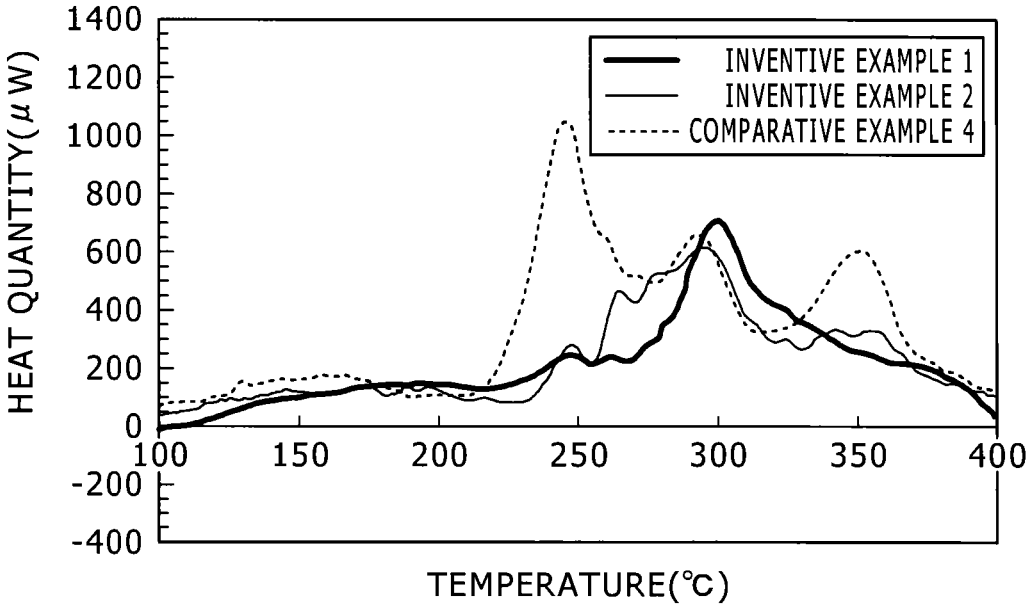
1400
1200
1000
800
600
400
200
0
-200
-400
HEAT QUANTITY(μW)
100
150
200
250
300
350
400
TEMPERATURE(℃)
INVENTIVE EXAMPLE 1
INVENTIVE EXAMPLE 2
COMPARATIVE EXAMPLE 4

ALUMINUM ALLOY SHEET WITH EXCELLENT PAINT-BAKE HARDENABILITY

TECHNICAL FIELD

The present invention relates to an Al—Mg—Si-based aluminum alloy sheet. The aluminum alloy sheet described herein refers to a rolled sheet such as a hot-rolled sheet or a cold-rolled sheet, which is an aluminum alloy sheet subjected to tempering such as solution and hardening before being press-formed into a panel or before being subjected to paint-bake hardening after being formed into the panel. Hereinafter, aluminum may be referred to as Al.

BACKGROUND ART

Recently, social need for weight saving of vehicles such as motorcars has increased more and more out of consideration for the global environment. To meet such social need, as a material of an auto panel, particularly a large body panel (an outer panel and an inner panel) such as a hood, a door, and a roof, a more lightweight aluminum alloy material having excellent formability and paint-bake hardenability is increasingly used in place of steel materials such as steel sheets.

In particular, Al—Mg—Si-based aluminum alloy sheets such as AA-series or JIS6000-series, which may be simply referred to as 6000-series below, are used as thin and high-strength aluminum alloy sheets for panels including an outer panel and an inner panel of a panel structure such as a hood, a fender, a door, a roof, and a trunk lid of a motorcar.

The 6000-series (Al—Mg—Si-based) aluminum alloy sheet essentially includes Si and Mg. In particular, an excessive-Si-type 6000-series aluminum alloy has a composition where such Si and Mg satisfy Si/Mg of 1 or more in mass ratio, and exhibits excellent artificial age hardenability after forced heating. The aluminum alloy sheet therefore has paint-bake hardenability, which may be referred to as bake hardenability (=BH property) or baking hardenability below, that allows formability during press forming or bending to be ensured by lowered proof stress, and allows strength necessary for the formed panel to be ensured by increased proof stress due to artificial age hardening through forced heating during artificial aging (hardening) at relatively low temperature such as paint baking treatment of a formed panel.

Moreover, the 6000-series aluminum alloy sheet has a relatively small amount of alloy elements compared with other aluminum alloys such as 5000-series aluminum alloy having a large alloy amount such as Mg amount. Hence, when scrap of such a 6000-series aluminum alloy sheet is reused as an aluminum alloy melting material (melting source material), an original 6000-series aluminum alloy slab is easily reproduced, showing excellent recyclability of the 6000-series aluminum alloy sheet.

On the other hand, as well known, an outer panel of a motorcar is fabricated through various types of forming, such as stretch forming as a type of press forming and bending, performed on an aluminum alloy sheet. For example, in fabrication of a large outer panel such as a hood and a door, the aluminum alloy sheet is formed into a product shape of the outer panel by press forming such as stretch forming, and then the formed product is joined to an inner panel through hemming such as flat hem of the periphery of the outer panel, so that a panel structure is formed.

The outer panels of the motorcars tend to be reduced in thickness for weight saving, and are required to have higher strength so as to have excellent dent resistance despite the reduced thickness. Hence, the aluminum alloy sheet is further required to have the artificial age hardenability (paint-bake hardenability) that allows formability to be secured by lowered proof stress of the aluminum alloy sheet during press forming, and allows necessary strength to be secured even after thickness reduction by increased proof stress through age hardening caused by heating during artificial aging at relatively low temperature, such as paint baking of a formed panel.

It has been variously proposed that an Mg—Si-based cluster, which is formed in the 6000-series aluminum alloy sheet left at a room temperature after solution and hardening, is controlled for such paint-bake hardenability of the 6000-series aluminum alloy sheet. Each of such proposals mainly improves paint-bake hardenability by heat treatment, etc. after solution and hardening in fabrication of the aluminum alloy sheet. In a recently proposed technique, such an Mg—Si-based cluster is controlled after being measured with an endothermic peak and an exothermic peak on a differential scanning calorimetry curve, which may be referred to as DSC below, of the 6000-series aluminum alloy sheet.

For example, PTL 1 and PTL 2 each propose limiting production of such an Mg—Si-based cluster, particularly a Si/vacancy cluster (GPI), as a factor impairing the low-temperature age hardenability. In such techniques, it is defined that no endothermic peak exists in a temperature range from 150 to 250° C. corresponding to melt of GPI on DSC of T4 material (subjected to natural aging after solution) in order to limit production of GPI that impairs suppression of room-temperature aging and the low-temperature age hardenability. Furthermore, in such techniques, the aluminum alloy sheet is subjected to low-temperature heat treatment, i.e., held at 70 to 150° C. for about 0.5 to 50 hr after solution and hardening down to room temperature in order to suppress or control production of GPI.

As described in PTL 1 and PTL 2, GPI, which is formed during room-temperature after solution and hardening, is collapsed at paint baking, and solute concentration of a matrix is lowered, and therefore precipitation of a GP zone ($Mg_2Si$ precipitated phase) contributing to increase in strength is hindered, and thus the low-temperature age hardenability is impaired. Furthermore, formation of the GPI increases strength, and impairs suppression of room-temperature aging. Hence, suppressing formation of GPI improves the suppression of room-temperature aging and the low-temperature age hardenability. However, only suppressing formation of the GPI is not enough for the recently required improvement of paint-bake hardenability (low-temperature age hardenability). For example, while PTL 1 and PTL 2 each disclose the paint-bake hardenability, proof stress after BH under an artificial aging condition of 175° C.×30 min or 170° C.×20 min is at a level of about 168 MPa at a maximum, which does not satisfy 200 MPa or more required for this type of panel application.

PTL 3 proposes an excessive-Si-type 6000-series aluminum alloy material satisfying that height of a minus endothermic peak is 1000 μW or less in a temperature range from 150 to 250° C. corresponding to dissolving of a Si/vacancy cluster (GPI), and height of a plus exothermic peak is 2000 μW or less in a temperature range from 250 to 300° C. corresponding to precipitation of a Mg/Si cluster (GPII) on DSC of this aluminum alloy material subjected to tempering including solution and hardening. This aluminum alloy material, which is subjected to the above-described tempering and then subjected to room-temperature aging for at least four months, has the following properties: proof stress is within a range from 110 to 160 MPa, a difference in proof stress with respect to the aluminum alloy material immediately after the tempering is within 15 MPa, elongation is 28% or more, and proof stress is 180 MPa or more after low-temperature aging of 150° C.×20 min after application of strain of 2%.

However, such a technique of PTL 3 is also less likely to control an aluminum alloy sheet, of which the As proof stress immediately after tempering (fabrication) is less than 135 MPa, to have high proof stress, i.e., have proof stress after BH after paint-bake hardening (under a condition of 170° C.×20 min after application of strain of 2%) of nearly 240 MPa or more. In other words, the aluminum alloy sheet is less likely to have a paint-bake hardening property (BH property) ensuring a difference of 120 MPa or more between the proof stress after BH and the As proof stress.

In PTL 4, to attain the BH property after the paint-bake hardening under such a condition of low temperature and short time, it is defined that exothermic peak height W1 is 50 μW or more in a temperature range from 100 to 200° C., and a ratio of exothermic peak height W2 in a temperature range from 200 to 300° C. to the exothermic peak height W1 W2/W1 is 20.0 or less on a differential scanning calorimetry curve of the 6000-series aluminum alloy sheet subjected to tempering.

The exothermic peak W1 corresponds to precipitation of the GP zone to be a nucleation site of β" (a $Mg_2Si$ phase) during artificial age hardening, and as the peak height of W1 is higher, a larger amount of GP zone to be a nucleation site of β" during artificial age hardening is already formed in the tempered aluminum alloy sheet subjected. As a result, β" is promptly grown during paint-bake hardening after forming, so that paint-bake hardenability (artificial age hardenability) is improved. On the other hand, the exothermic peak W2 corresponds to a precipitation peak of β" itself, and height of the exothermic peak W2 is controlled to be as low as possible in order to lower the proof stress of the tempered (fabricated) aluminum alloy sheet to less than 135 MPa to ensure formability.

CITATION LIST

Patent Literature

[PTL 1] Japanese Unexamined Patent Application Publication No. JP10-219382.

[PTL 2] Japanese Unexamined Patent Application Publication No. 2000-273567.

[PTL 3] Japanese Unexamined Patent Application Publication No. 2003-27170.

[PTL 4] Japanese Unexamined Patent Application Publication No. 2005-139537.

SUMMARY OF INVENTION

Technical Problem

However, the technique of PTL 4 or other existing techniques is difficult to control the proof stress after BH after paint-bake hardening under a condition of low temperature and short time (under a condition of 170° C.×20 min after application of strain of 2%) of an aluminum alloy sheet, which has As proof stress immediately after tempering (fabrication) of less than 135 MPa, to be stably increased into a high proof stress with a difference of 100 MPa or more with respect to the As proof stress.

An object of the invention, which has been made in light of the above-described problems, is to provide an Al—Si—Mg-based aluminum alloy sheet that stably exhibits an excellent BH property even after being subjected to vehicle body paint baking under a condition of low temperature and shorter time after room-temperature aging.

Solution to Problem

To achieve the object, an aluminum alloy sheet having excellent paint-bake hardenability of the present invention is summarized by an Al—Mg—Si-based aluminum alloy sheet that contains, by mass percent, Mg: 0.2 to 2.0%, Si: 0.3 to 2.0%, and the remainder consisting of Al and inevitable impurities, and is subjected to solution hardening and reheating as tempering after rolling, wherein when an exothermic peak height in a temperature range from 230 to 270° C. is denoted as A, an exothermic peak height in a temperature range from 280 to 320° C. is denoted as B, and an exothermic peak height in a temperature range from 330 to 370° C. is denoted as C on a differential scanning calorimetry curve, the exothermic peak height B is 20 μW/mg or more, and the exothermic peak heights A and C are controlled together to satisfy a ratio of the exothermic peak height A to the exothermic peak height B A/B of 0.45 or less, and a ratio of the exothermic peak height C to the exothermic peak height B C/B of 0.6 or less, and when the aluminum alloy sheet is subjected to artificial age hardening of 170° C.×20 min after application of strain of 2%, an increase in 0.2% proof stress in a direction parallel to a rolling direction is 100 MPa or more.

Advantageous Effects of Invention

According to the invention, the proof stress after BH after paint-bake hardening under a condition of low temperature and short time (under a condition of 170° C.×20 min after application of strain of 2%) of an aluminum alloy sheet, which has an As proof stress immediately after tempering (fabrication) of less than 135 MPa, the proof stress after BH being improved into a high proof stress with a difference of 100 MPa or more with respect to the As proof stress, can be stably provided in a long sheet coil.

A coiled, wide and long aluminum alloy sheet fabricated through cold rolling is press-formed into a large number of, i.e., several hundreds of, panels of the motorcars over the area in a longitudinal direction of rolling. Even if a microstructure of such an aluminum alloy sheet is microscopically defined in size or density of compounds by microscopic analysis with a light microscope, SEM, TEM, or the like, such a definition does not ensure properties of the coiled, wide and long aluminum alloy sheet over the area in a longitudinal direction of rolling.

This is similar in the above-described existing technique where the Mg—Si-based cluster is controlled after being measured with an endothermic peak and an exothermic peak on a differential scanning calorimetry curve (DSC) of the 6000-series aluminum alloy sheet. In such DSC control, if the properties of the coiled, wide and long aluminum alloy sheet are not ensured over the area in a longitudinal direction of rolling, the BH property under the condition of low temperature and short time of a large number of panels formed from respective forming sites over the area in a longitudinal direction of rolling of one sheet cannot be improved or ensured together.

The invention makes it possible to, in such DSC control, ensure the properties of the coiled, wide and long aluminum alloy sheet over the area in a longitudinal direction of rolling, and improve or ensure together the BH properties under the condition of low temperature and short time of the large number of panels taken and formed from respective sites along the longitudinal direction of rolling of one sheet (coil).

BRIEF DESCRIPTION OF DRAWINGS

FIG. 1 is a schematic illustration showing a differential scanning calorimetry curve (DSC) of a measured aluminum alloy sheet.

DESCRIPTION OF EMBODIMENTS

Hereinafter, an embodiment of the present invention is specifically described on each of requirements. The aluminum alloy sheet described herein refers to a sheet (rolled sheet) that has been cold-rolled, tempered, and aged at room temperature as described above. Hence, the requirements defined in the invention are also on the aluminum alloy sheet not only immediately after tempering (immediately after fabrication of the sheet) but also after the lapse of an appropriate period (for example, after the lapse of one month or more from fabrication of the sheet) from end of tempering (end of fabrication of the sheet) to start of press forming or bending.

Differential Thermal Analysis:

In the invention, with a microstructure of a 6000-series (Al—Mg—Si-based) aluminum alloy sheet that is subjected to solution hardening and reheating as tempering after rolling, three (three places of) exothermic peak heights in specific temperature ranges particularly concerning the BH property are selected on a differential scanning calorimetry curve. In other words, the three exothermic peak heights in the specific temperature ranges particularly concerning the BH property are each controlled to improve the BH property (paint-bake hardening properties).

FIG. 1 illustrates DSC of each of three types of aluminum alloy sheets of inventive examples 1 and 2, and a comparative example 4 in Table 1 in Example described later by a thick solid line, a thin solid line, and a dot line, respectively.

In FIG. 1, an exothermic peak height A in a temperature range from 230 to 270° C., an exothermic peak height B in a temperature range from 280 to 320° C., and an exothermic peak height C in a temperature range from 330 to 370° C. on a differential scanning calorimetry curve are selected and controlled as the three exothermic peak heights particularly concerning the BH property. In the following description, the exothermic peaks having such exothermic peak heights A, B, and C are referred to as an exothermic peak a, an exothermic peak b, and an exothermic peak c, respectively.

The differential scanning calorimetry curve is a heating curve from a solid phase, the heating curve being obtained through measurement of thermal variation in a melting step of the aluminum alloy sheet after the tempering by differential thermal analysis under the following condition.

In the invention, this differential thermal analysis is conducted at ten points essentially including a leading portion, a central portion, and a trailing portion along a longitudinal direction of the tempered aluminum alloy sheet. Highest exothermic peak heights among exothermic peaks in each of the above-described temperature ranges are averaged for every ten measurement points, and the averaged exothermic peak height is determined as each of the exothermic peak heights A, B, and C. Through such DSC control, the properties of the coiled, wide and long aluminum alloy sheet are ensured over the area in the longitudinal direction of rolling, and the BH properties under the condition of low temperature and short time of a large number of panels formed from the respective forming sites over the area in the longitudinal direction of rolling of one sheet are improved or ensured together.

The differential thermal analysis at each measurement point of the sheet is conducted under the same condition: tester: DSC220G from Seiko Instruments Inc.; standard substance: aluminum; specimen container: aluminum; heating condition: 15° C./min; atmosphere: argon (50 ml/min); and specimen weight: 24.5 to 26.5 mg. The resultant profile (μW) of the differential thermal analysis is divided by the specimen weight so as to be normalized (μW/mg), and then a region where the profile of the differential thermal analysis becomes horizontal in a span of 0 to 100° C. is defined to be a reference level 0, and an exothermic peak height obtained by averaging the highest exothermic peak heights among exothermic peaks in each of the temperature ranges for every ten measurement points is determined to be each of the exothermic peak heights A, B, and C as an exothermic peak height from the reference level.

Exothermic Peak Height B:

The exothermic peak height B is the height of the exothermic peak b within the range from 280 to 320° C., and corresponds to a precipitation peak of β' (an intermediate phase). A sufficient increase in the exothermic peak height B as the peak of β' means that a larger amount of Mg or Si atoms are solid-solutionized, and there are a large amount of supersaturated vacancies quenched during solution hardening, the quenched supersaturated vacancies promoting the precipitation. In particular, the large amount of the supersaturated, solid-solutionized Mg and Si and the large number of quenched vacancies are advantageous for precipitation of the β" phase.

Hence, a certain amount (certain height) or more, i.e., 20 μW/mg or more of the exothermic peak height B is ensured to improve the BH (bake hard) property of the aluminum alloy sheet subjected to artificial age hardening of 170° C.×20 min after application of strain of 2%. If the exothermic peak height is less than 20 μW/mg, and even if other DSC requirements (A/B≤0.45 and C/B≤0.6) are satisfied, the increase in 0.2% proof stress in a direction parallel to a rolling direction of the aluminum alloy sheet, which is subjected to artificial age hardening of 170° C.×20 min after application of strain of 2%, cannot be adjusted to 100 MPa or more. As a result, the BH properties (paint-bake hardening properties) under the condition of low temperature and short time of a large number of panels, which are formed from respective forming sites over the area in a longitudinal direction of rolling of one sheet, cannot be improved or ensured together. Although the upper limit of the exothermic peak height B is not particularly specified, the upper limit is roughly about 50 μW/mg in light of a production limit. Consequently, the exothermic peak height B is preferably within a range from 20 μW/mg to 50 μW/mg.

Exothermic Peak Height A:

The exothermic peak height A is a height of the exothermic peak a within the range from 230 to 270° C., and corresponds to a precipitation peak of the β" phase that contributes to age hardening during artificial aging. In the existing DSC control, the exothermic peak height A is increased to ensure the Mg/Si cluster to be the nucleation site of the β" phase in order to improve the BH property under a condition of low temperature and short time. However, the invention conversely controls the exothermic peak height A to be reduced. In fact, the 6000-series aluminum alloy rolled sheet is solution-hardened and reheated, and heating rate, holding temperature, holding time, and cooling rate in the reheating are controlled to establish a reheating heat pattern that allows the exothermic peak height A to be lowered. In the invention, the Mg/Si cluster or the G. P. zone to be a nucleus of β" has been formed at the end of solution. In addition, the relationship with another exothermic peak height is further precisely controlled to promptly grow of β" during subsequent paint-bake treatment after forming of the sheet into the panel, thereby the BH property under the condition of low temperature and short time is improved.

A significantly lower exothermic peak height A than the exothermic peak height B means that β" corresponding to the peak A or a nucleus of β" is already formed before DSC measurement. A higher peak B means a larger amount of the supersaturated, solid-solutionized Mg and Si, which also concerns precipitation of β", and a large amount of quenched vacancies. Hence, the exothermic peak height A is controlled to be small in a relationship relative to the exothermic peak height B such that a ratio of the exothermic peak height A to the exothermic peak height B A/B satisfies A/B≤0.45. If the ratio A/B satisfies A/B≤0.45, the BH property under the condition of low temperature and short time is improved due to a synergistic effect with the above-described condition of the exothermic peak height B of 20 μW/mg or more.

On the other hand, if A/B becomes large (high) to exceed 0.45, and even if other DSC requirements (the exothermic peak height B of 20 μW/mg or more and C/B≤0.6) are satisfied, the increase in 0.2% proof stress in a direction parallel to the rolling direction of the aluminum alloy sheet, which is allowed to have strain of 2% and is then subjected to artificial age hardening of 170° C.×20 min, cannot be adjusted to 100 MPa or more. As a result, the BH properties under the condition of low temperature and short time of a large number of panels, which are formed from respective forming sites over the area in a longitudinal direction of rolling of one sheet, cannot be improved or ensured together. While the lower limit of the A/B is not particularly defined, it is roughly about 0.1 in light of a production limit. Consequently, A/B is preferably within a range from 0.1 to 0.45.

Exothermic Peak Height C:

The exothermic peak height C is a height of the exothermic peak c within the range from 330 to 370° C., and corresponds to a precipitation peak of a stable β phase ($Mg_2Si$). In the invention, it is experimentally found that as the precipitation peak is smaller, the BH property under the condition of low temperature and short time is more excellent. Thus, the exothermic peak height C is controlled together with the exothermic peak height A to be as small as possible in a relationship relative to the exothermic peak height B such that a ratio of the exothermic peak height C to the exothermic peak height B C/B satisfies C/B≤0.6. If the ratio C/B is controlled to satisfy C/B≤0.6, the BH property under the condition of low temperature and short time is improved due to a synergistic effect with the above-described conditions of the exothermic peak height B of 20 μW/mg or more and A/B≤0.45.

On the other hand, if the C/B becomes large (high) to exceed 0.6, and even if other DSC requirements (the exothermic peak height B of 20 μW/mg or more and A/B≤0.45) are satisfied, the increase in 0.2% proof stress in a direction parallel to the rolling direction of the aluminum alloy sheet, which is allowed to have strain of 2% and is then subjected to artificial age hardening of 170° C.×20 min, cannot be adjusted to 100 MPa or more. As a result, the BH properties (paint-bake hardening properties) under the condition of low temperature and short time of a large number of panels, which are formed from respective forming sites over the area in a longitudinal direction of rolling of one sheet, cannot be improved or ensured together. While the lower limit of the C/B is not particularly defined, it is roughly about 0.15 in light of a production limit. Consequently, C/B is preferably within a range from 0.15 to 0.6.

Although the mechanism of the exothermic peak height C is still not clear, it is estimated that the Mg and Si atoms being solid-solutionized in a supersaturated manner are substantially precipitated as the β" phase effective for strengthening or the β' phase formed in a further high temperature range, and therefore there is no condition for direct precipitation of the β phase from the Mg and Si being solid-solutionized in a supersaturated manner. When this is analyzed in conjunction with the small peak A due to a fact that the Mg/Si cluster or the G.P. zone to be a nucleus of β" is already formed during heating, and a high peak B corresponding to precipitation of β', it is estimated that the amount of quenched vacancies during solution hardening, or vacancies are efficiently used for formation of the Mg/Si cluster in subsequent pre-aging described later, or exist in a state where the vacancies accelerate precipitation of β'.

The vacancies relate to such precipitation. A smaller amount of vacancies exist at lower temperature from the equilibrium theory. The amount of vacancies, which are quenched in an unequilibrated state by hardening or the like, strongly relate to diffusion for precipitation, etc. In a heating step of DSC or the like, when temperature is raised into a high temperature range of about 300° or more, the amount of vacancies also increases from the equilibrium theory, which becomes dominant rather than influence of the quenched vacancies; hence, the quenched vacancies do not directly concern precipitation of the β phase. In other words, the following speculation may be made. In a low temperature range where the β" phase and the β' phase are precipitated, the quenched vacancies strongly relate to the precipitation behavior of the β" and β' phases, and thus the precipitation is further accelerated, which affects behavior of the β phase precipitated in the high temperature range.

The exothermic peaks a, b, and c of the exothermic peak heights A, B, and C exist in a state of "species" at room temperature, and cannot be analyzed nor detected by a typical analysis method in a state (normal room temperature) of the 6000-series aluminum alloy sheet as fabricated, i.e., in a state of the sheet after being subjected to solution hardening and reheating as tempering after rolling. In other words, the exothermic peaks a, b, and c of the exothermic peak heights A, B, and C are shown only when the tempered aluminum alloy sheet is heated in differential thermal analysis.

In addition, the exothermic peak heights A, B, and C, or the exothermic peaks a, b, and c are shown considerably late. Specifically, the peak height A, which is to be first shown, is shown only at a relatively high temperature, i.e., 230° C. or more. Hence, even if differential thermal analysis is previously conducted many times, and if such exothermic peaks a, b, and c are not shown, or equivalently, if only a gentle DSC heating curve, in which the peaks cannot be detected in the temperature ranges, is obtained, existence of each of the exothermic peaks a, b, and c and behavior thereof are not known. The invention is made based on the findings on such existence of each of the exothermic peaks a, b, and c and the behavior (contribution) on the BH property under the condition of low temperature and short time.

Chemical Composition:

The chemical composition of the 6000-series aluminum alloy sheet is now described. The objective 6000-series aluminum alloy sheet of the invention is required to have various excellent properties including formability, the BH property, strength, weldability, and corrosion resistance as the sheet for the outer panel of the motorcar.

To satisfy such requirements, the aluminum alloy sheet has a composition including, by mass percent, Mg: 0.2 to 2.0%, Si: 0.3 to 2.0%, and the remainder consisting of Al and inevitable impurities. The percentage representing the content of each element refers to mass percent.

The objective 6000-series aluminum alloy sheet of the invention is preferably an excessive-Si-type 6000-series aluminum alloy sheet that has a further excellent BH property, and has a mass ratio of Si to Mg, Si/Mg, of 1 or more. The 6000-series aluminum alloy sheet has aging hardenability (BH property) that allows formability during press forming or bending to be ensured by lowered proof stress, and allows strength necessary for the formed panel to be ensured by increased proof stress due to age hardening through heating during artificial aging at relatively low temperature such as paint baking treatment of a formed panel. In particular, the excessive-Si-type 6000-series aluminum alloy sheet has a more excellent BH property than a 6000-series aluminum alloy sheet having the mass ratio Si/Mg of less than 1.

In the invention, elements other than Mg and Si are basically impurities or containable elements. The content (allowable amount) of each of such elements is at a level of each element according to the AA standard or the JIS standard.

Specifically, when not only high-purity Al bullion, but also scrap materials of the 6000-series alloy or other aluminum alloys containing elements other than Mg and Si as additive elements (alloy elements), low-purity Al bullion, and the like are used in large quantity as melting material of alloy from the viewpoint of resource recycle in the invention, the following other elements are necessarily contained in an effective quantity. Refining for intentionally reducing such elements also increases cost, and therefore the elements must be allowed to be contained in some degree. In a certain content range, even if an effective amount of each of the elements is contained, the object and the effects of the invention are not substantially affected.

Hence, the invention permits each of the elements to be contained within a content range equal to or lower than the upper limit defined below according to the AA standard or the JIS standard. Specifically, one or more of Mn: 1.0% or less (not including 0%), Cu: 1.0% or less (not including 0%), Fe: 1.0% or less (not including 0%), Cr: 0.3% or less (not including 0%), Zr: 0.3% or less (not including 0%), V: 0.3% or less (not including 0%), Ti: 0.05% or less (not including 0%), Zn: 1.0% or less (not including 0%), and Ag: 0.2% or less (not including 0%) may be further contained in addition to the above-described basic composition.

The content range and the meaning of each element or the allowable amount thereof in the 6000-series aluminum alloy are now described.

Si: 0.3 to 2.0%

Si is an important element as with Mg for satisfying the control or definition of each of the exothermic peak heights A, B, and C, which affect the BH property, on DSC defined in the invention. Si is an essential element that allows the aluminum alloy sheet to exhibit a solution strengthening property, and exhibit age hardenability through formation of age precipitates contributing to an increase in strength during the artificial aging at low temperature such as paint baking to ensure strength (proof stress) necessary for an outer panel of a motorcar. Furthermore, Si is the most important element that allows the 6000-series aluminum alloy sheet of the invention to have various properties, which each affect press formability, such as total elongation.

To allow the aluminum alloy sheet to exhibit excellent age hardenability in paint baking under the condition of lower temperature and shorter time after being formed into a panel, Si/Mg is preferably adjusted to 1.0 or more in mass ratio to produce a 6000-series aluminum alloy composition in which Si is further excessively contained with respect to Mg compared with the typical excessive-Si-type.

If the Si content is excessively small, the absolute amount of Si is insufficient; hence, the control or definition of each of the exothermic peak heights A, B, and C, which affect the BH property, on DSC defined in the invention cannot be satisfied, and consequently the BH property is significantly worsened. Furthermore, the aluminum alloy sheet cannot have various properties such as total elongation required for various applications. On the other hand, if the Si content is excessively large, coarse crystallized compounds and precipitates are formed, leading to significant degradation in bendability and significant reduction in total elongation. Furthermore, weldability is also significantly impaired. Consequently, Si is within a range from 0.3 to 2.0%.

Mg: 0.2 to 2.0%

Mg is also an important element as with Si for satisfying the control or definition of each of the exothermic peak heights A, B, and C, which affect the BH property, on DSC defined in the invention. Mg is an essential element that allows the aluminum alloy sheet to exhibit a solution strengthening property, and exhibit age hardenability through formation of age precipitates contributing to an increase in strength, as with Si, during the artificial aging such as paint baking to ensure proof stress necessary for a panel.

If the Mg content is excessively small, the absolute amount of Mg is insufficient; hence, the control or definition of each of the exothermic peak heights A, B, and C, which affect the BH property, on DSC defined in the invention cannot be satisfied, and consequently the BH property is significantly worsened. As a result, the proof stress necessary for the panel is not ensured. On the other hand, if the Mg content is excessively large, coarse crystallized compounds and precipitates are formed, leading to significant degradation in bendability and significant reduction in total elongation. Consequently, Mg is within a range from 0.2 to 2.0%, and preferably adjusted into an amount such that Si/Mg is 1.0 or more in mass ratio.

Manufacturing Method:

A method of manufacturing the aluminum alloy sheet of the invention is now described. The manufacturing process of the aluminum alloy sheet of the invention is a common process or a known process, in which an aluminum alloy slab having the 6000-series composition is casted, and is then subjected to homogenization heat treatment, and is then hot-rolled and cold-rolled into a sheet having a predetermined thickness. The sheet is then subjected to tempering such as solution hardening into the aluminum alloy sheet of the invention.

During such a manufacturing process, the reheating condition after solution and hardening must be more appropriately controlled as described later in order to satisfy the control or definition of each of the exothermic peak heights A, B, and C, which affect the BH property, on DSC defined in the invention. In each of other steps, there is also a preferable condition for controlling each of the exothermic peak heights A, B, and C on DSC to be within the range defined in the invention.

(Melting and Casting Cooling Rate)

First, in melting and casting steps, molten metal of aluminum alloy, which is melted and adjusted to be within the 6000-series composition range, is casted by an appropriately selected common melting and casting process such as a continuous casting process and a semi-continuous casting process (DC casting process) The average cooling rate during casting is preferably controlled to be as large (fast) as possible, i.e., 30° C./min or more from the liquidus temperature to the solidus temperature in order to control the Mg—Si-based cluster to be within the range defined in the invention.

When such temperature (cooling rate) control in a high temperature region during casting is not performed, the cooling rate in the high temperature region necessarily becomes lower. When the average cooling rate in the high temperature region thus becomes lower, the amount of crystallized compounds that are coarsely generated within the temperature range in the high temperature region increases, and variations in size and amount of the crystallized compounds also increase in each of a width direction and a thickness direction of the slab. As a result, the control or definition of each of the exothermic peak heights A, B, and C, which affect the BH property, on DSC defined in the invention may not be highly possibly satisfied.

(Homogenization Heat Treatment)

Subsequently, the casted aluminum alloy slab is subjected to homogenization heat treatment prior to hot rolling. An object of this homogenization heat treatment (soaking) is to homogenize a microstructure, i.e., eliminate segregation in a crystal grain of a slab microstructure. Any condition of the homogenization heat treatment may be used without limitation as long as such an object is achieved, i.e., one time or one stage of treatment may be performed as usual.

Temperature of the homogenization heat treatment is 500° C. or higher and lower than a melting point, and homogenization time is appropriately selected from a range of four hours or more. If the homogenization temperature is low, segregation in the crystal grain cannot be sufficiently eliminated, and may act as an origin of fracture; hence, stretch-flangeability and bendability are worsened. Subsequently, hot rolling is started immediately or after cooling of the slab to an appropriate temperature and holing at the temperature. In each case, the control or definition of each of the exothermic peak heights A, B, and C, which affect the BH property, on DSC defined in the invention can be satisfied.

After the homogenization heat treatment, the aluminum alloy slab is cooled to room temperature at an average cooling rate of 20 to 100° C./hr in a range from 300 to 500° C. Subsequently, the slab may be reheated to 350 to 450° C. at an average heating rate of 20 to 100° C./hr, and hot rolling may be started in that temperature range. In other words, two stages of homogenization heat treatment may be performed.

If the condition of the average cooling rate after the homogenization heat treatment and the condition of the reheating rate are not satisfied, coarse Mg—Si compounds may be highly possibly formed.

(Hot Rolling)

Hot rolling is configured of a rough rolling step and a finish rolling step of a slab depending on thickness of a sheet to be rolled. In such rough rolling step and finish rolling step, a reverse-type or tandem-type rolling mill is appropriately used.

If this operation is performed under a condition that the hot rolling (rough rolling) start temperature exceeds the solidus temperature, since burning occurs, hot rolling itself becomes difficult. If the hot rolling start temperature is less than 350° C., since a load becomes excessively high during hot rolling, hot rolling itself becomes difficult. Consequently, the hot rolling (rough rolling) start temperature is in a range from 350° C. to the solidus temperature, and preferably in a range from 400° C. to the solidus temperature.

(Annealing of Hot-Rolled Sheet)

Although annealing (rough annealing) before cold rolling of the hot-rolled sheet is not necessarily required, the annealing may be carried out to improve propertied such as formability through refining of crystal grains or optimization of a texture.

(Cold Rolling)

In cold rolling, the hot-rolled sheet is rolled to be produced into a cold-rolled sheet (including a coil) having a desired final thickness. Cold reduction is desirably 60% or more in order to further refine the crystal grains. In addition, intermediate annealing may be performed between cold rolling passes for the same purpose as that of the rough annealing.

(Solution and Hardening)

The cold-rolled sheet is subjected to solution and hardening. The solution and hardening may be performed through heating and cooling in a normal continuous heat treatment line without limitation. However, a sufficient solid-solution amount of each element and finer crystal grains are desirable as described above. Hence, in a desirable condition, the cold-rolled sheet is heated to a solution temperature of 520° C. or higher at a heating rate of 5° C./sec or more, and is held at the temperature for 0 to 10 sec.

Furthermore, from the viewpoint of suppressing formation of grain-boundary compounds that impair formability and hem bendability, the sheet is desirably subjected to hardening at a cooling rate of 50° C./sec or more. If the cooling rate is low, Si, $Mg_2Si$, and the like are easily precipitated on the grain boundary, which tend to become crack origins during press forming or bending, and consequently the formability and the like are worsened. To achieve such a cooling rate, the hardening is conducted while cooling methods such as air cooling with a fan and water cooling with mist, spray, or immersion, and conditions thereof are selectively used.

(Reheating)

The cold-rolled sheet is thus hardened through cooling up to room temperature, and then reheated within one hour. This reheating is performed in such a manner that the sheet is held at two steps of temperature while heating rate, holding temperature, holding time, and cooling rate are controlled in each step. Specifically, in the first step, the sheet is reheated into a temperature range from 100 to 250° C. at an average heating rate of 10° C./sec or more, and is then held for 5 sec to 30 min at the achieving reheat temperature. In the second step, the sheet is cooled from the reheating temperature range to a temperature range from 70 to 130° C. at a cooling rate of 1° C./sec or more, and is then held for 10 min to 2 hours in the temperature range. The sheet is then cooled from the second-step reheating temperature range to room temperature at an average cooling rate of 1° C./hr or more.

If the room-temperature holding (standing) time from the end of the cooling of the hardening to the reheating exceeds one hour, or if the average heating rate is less than 10° C./sec, the Si/vacancy cluster (GPI), which is to be formed during room-temperature holding (room-temperature aging), is early formed, and the control or definition of each of the exothermic peak heights A, B, and C, which affect the BH property, on DSC defined in the invention cannot be satisfied, and consequently the BH property under the condition of low temperature and short time is not provided even after the room-temperature aging. In particular, the room-temperature holding (standing) time from the end of the cooling of the hardening to the reheating is preferably shorter. The average heating rate is preferably faster, and is adjusted to 15° C./sec or more, preferably 20° C./sec or more, by a high-speed heating method such as high-frequency heating.

(First-Step Reheating)

In the first-step reheating, the sheet is reheated at the temperature of 100 to 250° C. When the reheating temperature is less than 100° C., the definition of each of the exothermic peak heights A, B, and C, which affect the BH property, on DSC defined in the invention is not provided, and consequently the BH property under the condition of low temperature and short time is not provided even after the room-temperature aging. In a condition of the heating temperature of more than 250° C., the Si/vacancy cluster is formed at a density over the predetermined cluster density defined in the invention, or an intermetallic compound phase such as β' other than the cluster is formed, and consequently formability and bendability are rather worsened.

In the first-step reheating, not only the reheating temperature but also the average heating rate and the holding time at the achieving reheating temperature greatly affect the control of each of the exothermic peak heights A, B, and C, which affect the BH property, on DSC defined in the invention. If the average heating rate is too low, i.e., less than 10° C./sec, or if the holding time is too short, i.e., less than 5 sec, the definition of each of the exothermic peak heights A, B, and C, which affect the BH property, on DSC defined in the invention is not provided, and consequently the BH property under the condition of low temperature and short time is not provided even after the room-temperature aging. If the sheet is held at the holding temperature for an excessively long time, the Si/vacancy cluster is formed at a density over the predetermined cluster density defined in the invention, or an intermetallic compound phase such as β' other than the cluster is formed, and consequently formability and bendability may be worsened.

(Second-Step Reheating)

In the second-step reheating, the sheet is directly cooled from the temperature range of the first-step reheating, and reheated in the temperature range from 70 to 130° C. The second-step reheating is a process necessary for further stably growing the Mg/Si cluster (GPII) that is acceleratingly formed thanks to the quenched vacancies by raising the temperature into the high temperature range in the first step. When the second-step reheating temperature is less than 70° C., the definition of each of the exothermic peak heights A, B, and C, which affect the BH property, on DSC defined in the invention is also not provided, and consequently the BH property under the condition of low temperature and short time is not provided even after the room-temperature aging. In a condition of the heating temperature of more than 130° C., the Si/vacancy cluster is formed at a density over the predetermined cluster density defined in the invention, or an intermetallic compound phase such as β' other than the cluster is formed, and consequently formability and bendability are worsened.

In the second-step reheating, not only the reheating temperature but also the average cooling rate from the first-step reheating temperature range and the holding time at the achieving reheating temperature greatly affect the control of each of the exothermic peak heights A, B, and C, which affect the BH property, on DSC defined in the invention. If the holding time in the second step is too short, the definition of each of the exothermic peak heights A, B, and C, which affect the BH property, on DSC defined in the invention is not provided, and consequently the BH property under the condition of low temperature and short time is not provided even after the room-temperature aging. If the average cooling rate from the first-step reheating temperature range is too low, or if the sheet is held at the holding time in the second step for an excessively long time, the Si/vacancy cluster is formed at a density over the predetermined cluster density defined in the invention, or an intermetallic compound phase such as β' other than the cluster is formed, and consequently formability and bendability may be worsened.

(Cooling after Reheating)

After the 6000-series aluminum alloy rolled-sheet is subjected to such a series of tempering, as the elapsed time at room temperature before the BH treatment is longer, precipitation of precipitates is more hindered during the BH treatment, and the BH property is more worsened. In contrast, as the elapsed time at room temperature is shorter, the 6000-series aluminum alloy sheet is prompted in precipitation of precipitates during the BH treatment, and is improved in BH property. However, such elapsed time at room temperature from the end of the tempering to start of the BH treatment varies depending on conditions of a motorcar manufacturing line, and is therefore difficult to be controlled.

Hence, the invention is designed such that the definition of each of the exothermic peak heights A, B, and C, which affect the BH property, on DSC defined in the invention is satisfied before time has passed at room temperature by controlling the reheating condition in the tempering, particularly the cooling condition after the reheating. Specifically, the average cooling rate is specified to be 1° C./hr or more.

Even if previous fabrication conditions and other reheating conditions are satisfied, and if one condition, such as a detailed condition of the above-described two-step cooling after the reheating, is not appropriate, the control or definition of each of the exothermic peak heights A, B, and C, which affect the BH property, on DSC defined in the invention may not be highly possibly satisfied.

Specifically, if the average cooling rate is less than 1° C./hr, a large number of each of the exothermic peaks a and c, which affect the BH property, on DSC defined in the invention are shown and cannot be controlled, and consequently such definition cannot be satisfied.

Although the invention is now described in detail with Example, the invention should not be limited thereto, and appropriate modifications or alterations thereof may be made within the scope without departing from the gist described before and later, all of which are included in the technical scope of the invention.

EXAMPLE

Example of the invention is now described. In the Example, 6000-series aluminum alloy sheets, of each of which the respective exothermic peak heights A, B, and C on DSC defined in the invention were different from one another, were appropriately fabricated depending on reheating conditions after solution and hardening, and were each evaluated in BH property (paint baking hardenability) under the condition of low temperature and short time after tempering. In addition, press formability and hem bendability were also evaluated.

The appropriate fabrication was performed using 6000-series aluminum alloy sheets having compositions as shown in Table 1 while reheating conditions after solution and hardening, including heating temperature (° C.) (shown as achieving temperature in Table 2), holding time (hr), and particularly a cooling condition after such heating and holding were varied. In representation of the content of each element in Table 1, representation with no numerical value for each element indicates that the content is equal to or lower than the detection limit.

Specific fabrication conditions of the aluminum alloy sheets are as follows. Any of slabs having the compositions shown in Table 1 was ingoted by a DC casting process. At this time, average cooling rate during casting was 50° C./min in a range from the liquidus temperature to the solidus temperature in any of examples. Subsequently, the slab in any of examples was subjected to soaking of 540° C.×6 hr, and was then subjected to hot rough rolling at a hot rolling (rough rolling) start temperature of 500° C. In any of examples, the slab was hot-rolled into a thickness of 3.5 mm by subsequent finish rolling, and thus formed into a hot-rolled sheet (coil). In any of examples, the hot-rolled aluminum alloy sheet was subjected to rough annealing of 500° C.×1 min, and was then subjected to cold rolling with reduction of 70% without intermediate annealing between cold rolling passes and thus formed into a cold-rolled sheet (coil) 1.0 mm in thickness.

Furthermore, in any of examples, such a cold-rolled sheet was subjected to tempering (T4) by continuous heat treatment equipment. Specifically, the cold-rolled sheet was subjected to solution and hardening, in which the sheet was heated to a solution temperature shown in Table 2 at an average heating rate of 10° C./sec up to 500° C., and then immediately cooled to room temperature at an average cooling rate as shown in Table 2. Subsequently, in any of examples, the sheet was subjected to reheating on-line by the same continuous heat treatment equipment under each of conditions shown in Table 2.

Test sheets (blanks) were appropriately cut from each final product sheet that was left at room temperature for two months after such tempering, and a microstructure and properties of each test sheet were measured and evaluated. Table 3 shows results of such measurement and evaluation.

Differential Thermal Analysis:

Specimens for the differential thermal analysis was exclusively sampled at ten points essentially including a leading portion, a central portion, and a trailing portion along a longitudinal direction of the tempered aluminum alloy sheet. Highest exothermic peak heights among exothermic peaks, which are shown under the above-described test condition, in each of the above-described temperature ranges are averaged for every ten measurement points described above, and the averaged exothermic peak height is determined as each of the exothermic peak heights A, B, and C.

(Paint Baking Hardenability)

As mechanical properties of each test sheet after being left for one month at room temperature after the tempering, 0.2% proof stress (As proof stress) and total elongation (As total elongation) were determined by a tensile test. With any of such test sheets, 0.2% proof stress (proof stress after BH) of each test sheet (after BH), which was subjected to low-temperature, short-time artificial age hardening of 170° C.×20 min after application of strain of 2%, was determined by a tensile test. The BH property of each test sheet was evaluated from a difference (an increase in proof stress) between such two types of 0.2% proof stress.

In the tensile test, a JIS Z2201 No. 5 test specimen (25 mm×50 mm gage length (GL)×thickness) was extracted from each test sheet for the tensile test at room temperature. In this tensile test, the tensile direction of the test specimen was perpendicular to the rolling direction. The tensile speed was 5 mm/min below the 0.2% proof stress and 20 mm/min over the 0.2% proof stress. The number N of measurement of the mechanical properties was five, and an average of each property was calculated. The test specimen for proof stress measurement after the BH treatment was allowed to have pre-strain of 2% as simulated press forming of a sheet by such a tensile tester before the BH treatment.

(Hem Bendability)

Hem bendability was examined only on each of test specimens left at room temperature for two months after the tempering. The test was conducted using a strip specimen 30 mm wide through bending at a 90-degree angle with inner bending radius R of 1.0 mm using a down flange, pre-hemming where a folded portion was further folded inside about 130 degrees while an inner 1.0 mm thick was inserted, and flat hemming where an end portion of the folded portion was allowed to be into tight contact with the inner through folding at a 180-degree angle.

A bent portion (curled portion) of the flat hem was visually observed in surface state such as roughing, microcrack, and large crack, and the surface state was visually evaluated according to the following criteria:

0: no crack and no roughing; 1: slight roughing; 2: deep roughing; 3: surface microcrack; 4: linearly continued surface crack; and 5: breaking.

As shown in Tables 1 to 3, an aluminum alloy sheet of each inventive example has a composition within a range of the composition according to the invention, and is fabricated and tempered within a preferable condition range. Specifically, in the invention, a cold-rolled sheet was subjected to solution and hardening with cooling up to room temperature, and was then reheated within one hour. In control of a heat pattern of this reheating, a first-step reheating was conducted such that the sheet was reheated into a temperature range from 100 to 250° C. at an average heating rate of 10° C./sec or more, and held for 5 sec to 30 min at the achieving reheating temperature. The sheet was then cooled into a second-step reheating temperature range at an average cooling rate of 1° C./sec or more, and was then held for 10 min to 2 hours within a temperature range from 70 to 130° C. The sheet was cooled from the second-step reheating temperature range at an average cooling rate of 1° C./hr or more.

As a result, as shown in Table 3, each inventive example satisfies the control or definition of each of the exothermic peak heights A, B, and C, which affect the BH property, on DSC defined in the invention, and shows an excellent BH property even if each sheet is subjected to long-term room-temperature aging after the tempering and subjected to paint baking hardening under a condition of low temperature and short time. Furthermore, each inventive example shows excellent elongation and hem bendability even after long-term room-temperature aging after the tempering.

Comparative examples 3 to 10 listed in Tables 2 and 3 each use inventive alloy example 2 in Table 1. However, as shown in Table 2, each of such comparative examples does not satisfy the preferable range of the reheating condition. As a result, each of such comparative examples does not satisfy the definition of each of the exothermic peak heights A, B, and C, which affect the BH property, on DSC defined in the invention, and is thus inferior particularly in BH property compared with inventive example 2 having the same alloy composition.

Comparative examples 12 to 16 listed in Tables 2 and 3 each use inventive alloy example 5 in Table 1. However, as shown in Table 2, each of such comparative examples does not satisfy the preferable range of the reheating condition. As a result, each of such comparative examples does not satisfy the definition of each of the exothermic peak heights A, B, and C, which affect the BH property, on DSC defined in the invention, and is thus inferior particularly in BH property compared with inventive example 11 having the same alloy composition.

Comparative examples 18 to 22 listed in Tables 2 and 3 each use inventive alloy example 8 in Table 1. However, as shown in Table 2, each of such comparative examples does not satisfy the preferable range of the reheating condition. As a result, each of such comparative examples 18 to 22 does not satisfy the definition of each of the exothermic peak heights A, B, and C, which affect the BH property, on DSC defined in the invention, and is thus inferior particularly in BH property compared with inventive example 17 having the same alloy composition.

Comparative examples 34 to 40 listed in Tables 2 and 3 are each fabricated within the preferable condition range including the reheating condition, but each do not satisfy the range of the invention of the content of Mg or Si as the essential element, or contains an excessive amount of impurity elements. As a result, as shown in Table 3, each of such comparative examples 34 to 40 does not satisfy one of the cluster conditions defined in the invention, and is thus inferior in BH property and hem bendability compared with each inventive example.

Comparative example 34 uses alloy 16 in Table 1 having excessive Si.

Comparative example 35 uses alloy 17 in Table 1 having excessive Zr.

Comparative example 36 uses alloy 18 in Table 1 having excessive Fe.

Comparative example 37 uses alloy 19 in Table 1 having excessive V.

Comparative example 38 uses alloy 20 in Table 1 having excessive Ti.

Comparative example 39 uses alloy 21 in Table 1 having excessive Cu.

Comparative example 40 uses alloy 22 in Table 1 having excessive Zn.

Such results of the Example support that the definition of each of the exothermic peak heights A, B, and C defined in the invention must be satisfied for improving the BH property under the condition of low temperature and short time after the long-term room-temperature aging. Furthermore, the results support the critical meaning or effects of the requirements for the composition or the preferable fabrication conditions according to the invention for securing such a cluster condition and a BH property.

TABLE 1

| | Alloy | Chemical composition of Al—Mg—Si alloy sheet (mass %, remainder: Al) | | | | | | | | | | |
|---|---|---|---|---|---|---|---|---|---|---|---|---|
| Classification | No. | Mg | Si | Fe | Mn | Cr | Zr | V | Ti | Cu | Zn | Ag |
| Inventive example | 1 | 0.55 | 0.9 | | | | | | | | | |
| | 2 | 0.55 | 0.9 | 0.2 | | | | | | | | |
| | 3 | 0.5 | 1.1 | 0.2 | | | | | | | | |
| | 4 | 0.4 | 1.2 | 0.9 | | | | | 0.1 | | | |
| | 5 | 0.6 | 1.4 | 0.15 | 0.05 | | | | 0.01 | | | |
| | 6 | 0.3 | 1.3 | 0.4 | | 0.05 | | | 0.03 | | | |
| | 7 | 0.5 | 1.8 | 0.2 | 0.1 | | 0.2 | | | | | |
| | 8 | 0.9 | 0.8 | 0.2 | | 0.3 | | 0.05 | | | | |
| | 9 | 0.75 | 1.3 | 0.5 | 0.05 | | | | | 1.0 | | |
| | 10 | 1.1 | 0.5 | 0.2 | 0.9 | | 0.05 | | | | | |
| | 11 | 0.7 | 1.1 | 0.2 | | 0.1 | | 0.3 | | | | |
| | 12 | 0.6 | 1.2 | 0.3 | | | | | | 0.2 | | |
| | 13 | 0.5 | 0.9 | 0.6 | 0.3 | | | | | | 1.0 | |
| | 14 | 0.65 | 1.35 | 0.25 | | | 0.05 | | | | 0.2 | 0.05 |
| | 15 | 0.4 | 1.0 | 0.2 | 0.5 | | | | 0.02 | | | |
| Comparative example | 16 | 0.5 | 2.2 | 0.25 | 0.05 | | | | 0.01 | | | |
| | 17 | 0.8 | 1.3 | 0.2 | 0.5 | | 0.4 | | | | | |
| | 18 | 0.4 | 0.5 | 1.2 | | 0.1 | | | 0.01 | | | 0.01 |
| | 19 | 0.5 | 1.1 | 0.5 | 0.1 | | | 0.5 | 0.02 | | | |
| | 20 | 0.6 | 1.3 | 0.3 | | | | | 0.2 | | | |
| | 21 | 2.6 | 0.5 | 0.2 | | | | | | 1.2 | | |
| | 22 | 0.7 | 1.1 | 0.4 | | 0.1 | | | | | 1.2 | |

* A column with no numerical value of each element represents a value equal to or lower than a detection limit.

TABLE 2

| | | | Solution hardening | | Reheating | | | | | | | |
|---|---|---|---|---|---|---|---|---|---|---|---|---|
| | | | | | | First stage | | | Second stage | | | |
| Classification | No. | Alloy No. in Table 1 | Solution temperature ° C. | Average cooling rate ° C./s | Time before reheating s | Average heating rate ° C./s | Achieving temperature ° C. | Holding time s | Average cooling rate ° C./s | Holding temperature ° C. | Holding time min | Average cooling rate ° C./hr |
| Inventive example | 1 | 1 | 540 | 100 | 600 | 20.0 | 250 | 120 | 5 | 100 | 60 | 2.0 |
| Inventive example | 2 | 2 | 540 | 100 | 600 | 10.0 | 110 | 10 | 2 | 100 | 60 | 2.0 |
| Comparative example | 3 | 2 | 540 | 100 | 4000 | 10.0 | 150 | 120 | 5 | 100 | 60 | 2.0 |
| Comparative example | 4 | 2 | 540 | 100 | 600 | 1.0 | 150 | 120 | 5 | 100 | 60 | 2.0 |
| Comparative example | 5 | 2 | 540 | 100 | 600 | 10.0 | 90 | 120 | 5 | 70 | 60 | 2.0 |
| Comparative example | 6 | 2 | 540 | 100 | 600 | 10.0 | 150 | 3000 | 5 | 100 | 60 | 2.0 |
| Comparative example | 7 | 2 | 540 | 100 | 600 | 10.0 | 150 | 120 | 0.1 | 100 | 60 | 2.0 |
| Comparative example | 8 | 2 | 540 | 100 | 600 | 10.0 | 150 | 120 | 5 | 60 | 60 | 2.0 |
| Comparative example | 9 | 2 | 540 | 100 | 600 | 10.0 | 150 | 120 | 5 | 100 | 2 | 2.0 |
| Comparative example | 10 | 2 | 540 | 100 | 600 | 10.0 | 150 | 120 | 5 | 100 | 60 | 0.5 |
| Inventive example | 11 | 5 | 550 | 70 | 900 | 15.0 | 200 | 5 | 10 | 90 | 120 | 5.0 |
| Comparative example | 12 | 5 | 545 | 70 | 900 | 15.0 | 200 | 5 | 0.5 | 90 | 60 | 2.0 |
| Comparative example | 13 | 5 | 545 | 70 | 900 | 15.0 | 200 | 5 | 5 | 150 | 60 | 2.0 |
| Comparative example | 14 | 5 | 545 | 70 | 900 | 15.0 | 200 | 120 | 5 | 130 | 1 | 2.0 |
| Comparative example | 15 | 5 | 545 | 70 | 900 | 15.0 | 200 | 120 | 5 | 130 | 180 | 2.0 |
| Comparative example | 16 | 5 | 545 | 70 | 900 | 15.0 | 200 | 120 | 5 | 130 | 60 | 0.1 |
| Inventive example | 17 | 8 | 550 | 50 | 2000 | 20.0 | 240 | 10 | 10 | 120 | 30 | 2.0 |
| Comparative example | 18 | 8 | 550 | 50 | 2000 | 4.0 | 240 | 5 | 5 | 120 | 30 | 2.0 |
| Comparative example | 19 | 8 | 550 | 50 | 2000 | 20.0 | 80 | 5 | 5 | 70 | 30 | 2.0 |
| Comparative example | 20 | 8 | 550 | 50 | 2000 | 20.0 | 240 | 2100 | 5 | 120 | 30 | 2.0 |
| Comparative example | 21 | 8 | 550 | 50 | 2000 | 20.0 | 240 | 5 | 5 | 50 | 30 | 2.0 |
| Comparative example | 22 | 8 | 550 | 50 | 2000 | 20.0 | 240 | 5 | 5 | 120 | 150 | 2.0 |
| Inventive example | 23 | 3 | 535 | 85 | 240 | 30.0 | 140 | 1200 | 5 | 110 | 15 | 2.0 |
| Inventive example | 24 | 4 | 540 | 50 | 900 | 40.0 | 210 | 300 | 15 | 120 | 15 | 4.0 |
| Inventive example | 25 | 6 | 520 | 80 | 360 | 10.0 | 180 | 60 | 10 | 80 | 60 | 2.0 |
| Inventive example | 26 | 7 | 530 | 90 | 1200 | 15.0 | 100 | 120 | 1 | 90 | 120 | 2.0 |
| Inventive example | 27 | 9 | 560 | 110 | 180 | 5.0 | 150 | 60 | 2 | 110 | 30 | 2.0 |
| Inventive example | 28 | 10 | 555 | 80 | 600 | 12.0 | 220 | 5 | 10 | 100 | 45 | 5.0 |
| Inventive example | 29 | 11 | 530 | 70 | 1800 | 50.0 | 200 | 60 | 10 | 130 | 10 | 2.0 |
| Inventive example | 30 | 12 | 500 | 50 | 60 | 15.0 | 120 | 300 | 2 | 100 | 120 | 2.0 |
| Inventive example | 31 | 13 | 540 | 80 | 300 | 20.0 | 240 | 5 | 20 | 120 | 15 | 3.0 |
| Inventive example | 32 | 14 | 545 | 100 | 1200 | 80.0 | 190 | 60 | 15 | 90 | 60 | 4.0 |
| Inventive example | 33 | 15 | 525 | 50 | 300 | 10.0 | 160 | 120 | 10 | 95 | 90 | 4.0 |
| Comparative example | 34 | 16 | 540 | 80 | 1200 | 10.0 | 150 | 60 | 5 | 100 | 30 | 2.0 |
| Comparative example | 35 | 17 | 540 | 80 | 1200 | 10.0 | 150 | 60 | 5 | 100 | 30 | 2.0 |
| Comparative example | 36 | 18 | 540 | 80 | 1200 | 10.0 | 150 | 60 | 5 | 100 | 30 | 2.0 |
| Comparative example | 37 | 19 | 540 | 80 | 1200 | 10.0 | 150 | 60 | 5 | 100 | 30 | 2.0 |
| Comparative example | 38 | 20 | 540 | 80 | 1200 | 10.0 | 150 | 60 | 5 | 100 | 30 | 2.0 |
| Comparative example | 39 | 21 | 540 | 80 | 1200 | 10.0 | 150 | 60 | 5 | 100 | 30 | 2.0 |
| Comparative example | 40 | 22 | 540 | 80 | 1200 | 10.0 | 150 | 60 | 5 | 100 | 30 | 2.0 |

TABLE 3

| | | | Microstructure and properties of tempered aluminum alloy sheet | | | | | | | | | |
|---|---|---|---|---|---|---|---|---|---|---|---|---|
| | | | DSC exothermic peak | | | | | As proof stress 0.2% MPa | Proof stress after BH 0.2% MPa | Increased amount of proof stress MPa | As total elongation % | Hem bendability |
| Classification | No. | Alloy No. in Table 1 | Exothermic peak height A μW/mg | Exothermic peak height B μW/mg | Exothermic peak height C μW/mg | A/B | C/B | | | | | |
| Inventive example | 1 | 1 | 9.43 | 26.43 | 9.92 | 0.36 | 0.38 | 132 | 242 | 110 | 28 | 1 |
| Inventive example | 2 | 2 | 10.31 | 25.21 | 12.76 | 0.41 | 0.51 | 123 | 229 | 106 | 28 | 1 |
| Comparative example | 3 | 2 | 20.71 | 23.88 | 14.59 | 0.87 | 0.61 | 128 | 201 | 73 | 28 | 1 |
| Comparative example | 4 | 2 | 41.61 | 27.14 | 23.95 | 1.53 | 0.88 | 129 | 200 | 71 | 28 | 1 |
| Comparative example | 5 | 2 | 47.69 | 24.94 | 22.43 | 1.91 | 0.90 | 131 | 198 | 67 | 28 | 1 |
| Comparative example | 6 | 2 | 6 | 16.78 | 7.57 | 0.36 | 0.45 | 153 | 214 | 61 | 27 | 4 |
| Comparative example | 7 | 2 | 6.82 | 17.69 | 9.18 | 0.39 | 0.52 | 144 | 209 | 65 | 28 | 3 |
| Comparative example | 8 | 2 | 15.18 | 25.14 | 16.43 | 0.60 | 0.65 | 126 | 194 | 68 | 28 | 1 |
| Comparative example | 9 | 2 | 14.94 | 24.51 | 15.61 | 0.61 | 0.64 | 130 | 197 | 67 | 28 | 1 |
| Comparative example | 10 | 2 | 8.2 | 18.59 | 10.78 | 0.44 | 0.58 | 147 | 215 | 68 | 28 | 3 |

TABLE 3-continued

| | | | Microstructure and properties of tempered aluminum alloy sheet | | | | | | | | | |
|---|---|---|---|---|---|---|---|---|---|---|---|---|
| | | | DSC exothermic peak | | | | | As proof stress 0.2% MPa | Proof stress after BH 0.2% MPa | Increased amount of proof stress MPa | As total elongation % | Hem bendability |
| Classification | No. | Alloy No. in Table 1 | Exothermic peak height A μW/mg | Exothermic peak height B μW/mg | Exothermic peak height C μW/mg | A/B | C/B | | | | | |
| Inventive example | 11 | 5 | 12.82 | 30.67 | 14.99 | 0.42 | 0.49 | 133 | 250 | 117 | 28 | 1 |
| Comparative example | 12 | 5 | 10.9 | 19.37 | 11.02 | 0.56 | 0.57 | 169 | 249 | 80 | 27 | 4 |
| Comparative example | 13 | 5 | 8.39 | 18.94 | 11.69 | 0.44 | 0.62 | 170 | 248 | 78 | 27 | 4 |
| Comparative example | 14 | 5 | 13.41 | 27.88 | 17.06 | 0.48 | 0.61 | 134 | 215 | 81 | 28 | 2 |
| Comparative example | 15 | 5 | 7.18 | 18 | 9.69 | 0.40 | 0.54 | 171 | 246 | 75 | 26 | 4 |
| Comparative example | 16 | 5 | 4.51 | 17.18 | 7.96 | 0.26 | 0.46 | 187 | 249 | 62 | 24 | 4 |
| Inventive example | 17 | 8 | 8.51 | 20.35 | 11.33 | 0.42 | 0.56 | 129 | 234 | 105 | 28 | 1 |
| Comparative example | 18 | 8 | 16.43 | 20.67 | 13.8 | 0.79 | 0.67 | 132 | 210 | 78 | 28 | 1 |
| Comparative example | 19 | 8 | 24.04 | 19.84 | 18.67 | 1.21 | 0.94 | 128 | 192 | 64 | 28 | 1 |
| Comparative example | 20 | 8 | 6.43 | 15.22 | 8.67 | 0.42 | 0.57 | 149 | 194 | 45 | 26 | 3 |
| Comparative example | 21 | 8 | 11.25 | 20.08 | 12.27 | 0.56 | 0.61 | 127 | 190 | 63 | 28 | 1 |
| Comparative example | 22 | 8 | 6.59 | 16.08 | 8.51 | 0.41 | 0.53 | 147 | 197 | 50 | 26 | 3 |
| Inventive example | 23 | 3 | 10.47 | 25.96 | 12.27 | 0.40 | 0.47 | 124 | 232 | 108 | 28 | 1 |
| Inventive example | 24 | 4 | 10.08 | 26.78 | 10.94 | 0.38 | 0.41 | 130 | 239 | 109 | 27 | 2 |
| Inventive example | 25 | 6 | 8.94 | 20.31 | 10.59 | 0.44 | 0.52 | 127 | 230 | 103 | 28 | 1 |
| Inventive example | 26 | 7 | 12.59 | 28.98 | 16.94 | 0.43 | 0.58 | 132 | 233 | 101 | 28 | 2 |
| Inventive example | 27 | 9 | 12.78 | 31.61 | 14.75 | 0.40 | 0.47 | 135 | 259 | 124 | 28 | 2 |
| Inventive example | 28 | 10 | 8.66 | 20.73 | 10.86 | 0.42 | 0.52 | 129 | 229 | 100 | 28 | 1 |
| Inventive example | 29 | 11 | 10.55 | 26.86 | 11.41 | 0.39 | 0.42 | 131 | 240 | 109 | 28 | 2 |
| Inventive example | 30 | 12 | 9.25 | 20.94 | 11.65 | 0.44 | 0.56 | 127 | 228 | 101 | 28 | 1 |
| Inventive example | 31 | 13 | 10.04 | 26.75 | 10.75 | 0.38 | 0.40 | 129 | 238 | 109 | 28 | 1 |
| Inventive example | 32 | 14 | 10.12 | 27.29 | 10.59 | 0.37 | 0.39 | 130 | 252 | 122 | 28 | 1 |
| Inventive example | 33 | 15 | 10.2 | 24.27 | 13.1 | 0.42 | 0.54 | 127 | 232 | 105 | 28 | 1 |
| Comparative example | 34 | 16 | 7.37 | 18.16 | 8.67 | 0.41 | 0.48 | 124 | 201 | 77 | 26 | 2 |
| Comparative example | 35 | 17 | 7.96 | 19.18 | 10.08 | 0.42 | 0.53 | 135 | 210 | 75 | 26 | 3 |
| Comparative example | 36 | 18 | 6.47 | 16.75 | 8.86 | 0.39 | 0.53 | 131 | 202 | 71 | 25 | 3 |
| Comparative example | 37 | 19 | 8.16 | 18.9 | 10.63 | 0.43 | 0.56 | 129 | 200 | 71 | 26 | 2 |
| Comparative example | 38 | 20 | 8.31 | 19.25 | 11.18 | 0.43 | 0.58 | 127 | 198 | 71 | 26 | 2 |
| Comparative example | 39 | 21 | 4.43 | 11.53 | 5.37 | 0.38 | 0.47 | 124 | 179 | 55 | 28 | 1 |
| Comparative example | 40 | 22 | 12.24 | 25.96 | 16.04 | 0.47 | 0.62 | 128 | 207 | 79 | 28 | 1 |

Although the invention has been described in detail with reference to specific embodiments, it should be understood by those skilled in the art that various alterations and modifications thereof may be made without departing from the spirit and the scope of the invention.

The present application is based on Japanese patent application (JP-2012-031811) filed on Feb. 16, 2012, the content of which is hereby incorporated by reference.

INDUSTRIAL APPLICABILITY

According to the invention, there can be provided a 6000-series aluminum alloy sheet having the BH property and the formability under the condition of low temperature and short time after long-term room-temperature aging over the entire span of a wide and long sheet. As a result, the 6000-series aluminum alloy sheet can be used for members or components, which are taken from the entire area of the sheet, of a motorcar, a ship or a transport aircraft of vehicles or the like, a household electric appliance, a building, and a structure, particularly for components of a transport aircraft of motorcars or the like.

The invention claimed is:

1. An aluminum alloy sheet, comprising:

an Al—Mg—Si-based aluminum alloy sheet that comprises, by mass percent, Mg: 0.2 to 2.0%, Si: 0.3 to 2.0%, and Al, and is subjected to solution hardening and reheating as tempering after rolling, wherein when an exothermic peak height in a temperature range from 230 to 270° C. is denoted as A, an exothermic peak height in a temperature range from 280 to 320° C. is denoted as B, and an exothermic peak height in a temperature range from 330 to 370° C. is denoted as C on a differential scanning calorimetry curve, the exothermic peak height B is 20 μW/mg or more, a ratio of the exothermic peak height A to the exothermic peak height B A/B is 0.45 or less, and a ratio of the exothermic peak height C to the exothermic peak height B C/B is 0.6 or less, and when the aluminum alloy sheet is subjected to artificial age hardening of 170° C.×20 min after application of strain of 2%, an increase in 0.2% proof stress in a direction parallel to a rolling direction is 100 MPa or more.

2. The aluminum alloy sheet according to claim 1, further comprising: one or more of Mn: from more than 0 to 1.0%,
Cu: from more than 0 to 1.0%,
Fe: from more than 0 to 1.0%,
Cr: from more than 0 to 0.3%,
Zr: from more than 0 to 0.3%,
V: from more than 0 to 0.3%,
Ti: from more than 0 to 0.05%,
Zn: from more than 0 to 1.0%, and
Ag: from more than 0 to 0.2%.

3. The aluminum alloy sheet according to claim 1, wherein the exothermic peak height B is 50 μW/mg or less.

4. The aluminum alloy sheet according to claim 1, wherein the ratio of A/B is 0.1 or more.

5. The aluminum alloy sheet according to claim 1, wherein the ratio of C/B is 0.15 or more.

6. The aluminum alloy sheet according to claim 1, obtained by a process comprising:

melting and casting an aluminum alloy to obtain an casted aluminum alloy slab, soaking the casted aluminum alloy slab to homogenize the microstructure of the slab and cooling the slab to room temperature, hot rolling the slab to obtain a hot-rolled sheet, optionally annealing the hot-rolled sheet, cold rolling the hot-rolled sheet to obtain a cold-rolled sheet, subjecting the cold-rolled sheet to solution and hardening, and subsequently subjecting the cold-rolled sheet to a reheating treatment comprising heating the cold-rolled sheet to a first reheating temperature of from 100 to 250° C. at an average heating rate of 10° C./sec or more within one hour and holding the sheet at the first reheating temperature for 5 seconds to 30 minutes, cooling the sheet from the first reheating temperature to a second reheating temperature of from 70 to 130° C. at an average cooling rate of 1° C./sec or more and holding the sheet at the second reheating temperature for 10 minutes to 2 hours, and cooling the sheet from the second reheating temperature to room temperature at an average cooling rate of 1° C./hr or more.

* * * * *